US009962708B2

(12) United States Patent
Papajewski

(10) Patent No.: US 9,962,708 B2
(45) Date of Patent: May 8, 2018

(54) GYRATORY CRUSHER

(71) Applicant: THYSSENKRUPP INDUSTRIAL SOLUTIONS AG, Essen (DE)

(72) Inventor: Detlef Papajewski, Bochum (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 65 days.

(21) Appl. No.: 14/891,894

(22) PCT Filed: May 14, 2014

(86) PCT No.: PCT/EP2014/059868
§ 371 (c)(1),
(2) Date: Nov. 17, 2015

(87) PCT Pub. No.: WO2014/187713
PCT Pub. Date: Nov. 27, 2014

(65) Prior Publication Data

US 2016/0144369 A1 May 26, 2016

(30) Foreign Application Priority Data

May 22, 2013 (DE) ..... 10 2013 008 612

(51) Int. Cl.
*B02C 2/00* (2006.01)
*B02C 2/10* (2006.01)

(52) U.S. Cl.
CPC ..... *B02C 2/005* (2013.01); *B02C 2/10* (2013.01)

(58) Field of Classification Search
CPC ..... B02C 2/005; B02C 2/10
(Continued)

(56) References Cited

U.S. PATENT DOCUMENTS 2,913,189 A * 11/1959 Werner ..... B02C 2/005 241/295
3,097,803 A * 7/1963 Dorsey ..... B02C 2/005 241/293

(Continued)

FOREIGN PATENT DOCUMENTS

DE 1107052 B 5/1961
DE 2025802 A 12/1970

(Continued)

OTHER PUBLICATIONS

English translation of International Search Report for International patent application No. PCT/EP2014/059868; dated Sep. 23, 2014.

(Continued)

*Primary Examiner* — Faye Francis
(74) *Attorney, Agent, or Firm* — thyssenkrupp North America, Inc.

(57) ABSTRACT

An example gyratory crusher for comminuting quarry material may comprise a crushing housing having a top and a bottom and a crushing cone having a top and a bottom. The crushing housing may be positioned around the crushing cone such that the crushing housing and the crushing cone form a circumferential crushing space having a crushing throat towards the top and a crushing gap towards the bottom. The crushing throat may be configured to receive quarry material, which, once comminuted, may exit the circumferential crushing space through the crushing gap. The circumferential crushing space may be tapered towards the crushing gap to facilitate this process. The crushing housing may include a crushing wall surface with an undulated surface disposed at least near the crushing throat. Waves of the undulated surface may include wave troughs and wave peaks and extend in a circumferential direction.

14 Claims, 2 Drawing Sheets

(58) Field of Classification Search
USPC ..... 241/207–216
See application file for complete search history.

(56) References Cited

U.S. PATENT DOCUMENTS

| | | | | |
|---|---|---|---|---|
| 3,614,004 | A | 10/1971 | Burkhardt et al. | |
| 2012/0048980 | A1* | 3/2012 | Schantz | B02C 1/00 241/291 |
| 2015/0314300 | A1* | 11/2015 | Malmqvist | B02C 2/005 241/285.2 |

FOREIGN PATENT DOCUMENTS

| | | | |
|---|---|---|---|
| EP | 0306023 | A1 | 3/1989 |
| EP | 0567077 | A2 | 10/1993 |
| JP | S62197156 | A | 8/1987 |
| JP | H05115803 | A | 5/1993 |
| JP | H07241483 | A | 9/1995 |
| JP | 2005185888 | A | 7/2005 |

OTHER PUBLICATIONS

English machine translation of DE1107052A.

* cited by examiner

GYRATORY CRUSHER

CROSS REFERENCE TO RELATED APPLICATIONS

This application is a U.S. National Stage Entry of International Patent Application Serial Number PCT/EP2014/059868, filed May 14, 2014, which claims priority to German patent application no. DE 102013008612.4 filed May 22, 2013, the entire contents of both of which are incorporated herein by reference.

FIELD

The present disclosure relates to a gyratory crusher for comminuting quarry material.

BACKGROUND

A gyratory crusher for comminuting quarry material is known from DE 1 107 052 A, the gyratory crusher having a crushing cone which is disposed so as be approximately centric in a crusher housing which is configured so as to be substantially rotationally symmetrical. The crushing cone, while being subject to slight autorotation, is eccentrically driven, such that the crushing space which is formed about the crushing cone is subjected to a revolving constriction of the gap. Quarry material, which is infed into the crushing space via the crushing throat is comminuted by the periodically constricted and re-widened crushing space, wherein comminution of the quarry material is accompanied by a downward movement of the progressively comminuted quarry material in the direction of the crushing gap; and when the quarry material is of a size that allows the quarry material to exit the crushing space by way of the crushing gap, said quarry material falls through the crushing gap and out of the crushing space.

An intake angle which opens up in the direction of the crushing throat lying thereabove may be defined in a radial plane of the crushing space, between the crusher housing which is configured in a funnel-shaped manner and the crushing cone which is likewise configured in a cone-shaped manner. Force components which may urge comparatively large fragments of the broken material back out of the crushing throat, or at least prevent the comparatively large fragments from being drawn into the intake cone between the crushing cone and the crusher housing, are generated during comminution of the quarry material. In order for drawing-in of the quarry material into the intake cone of the crusher to be facilitated, the crushing wall surface of the crusher housing and the surface of the crushing cone have crushing teeth which are attached in a strip-like manner to the surfaces, wherein the crushing teeth in their profile have a turn which facilitates drawing-in of the quarry material into the intake cone. The intake angle may thus be designed to be comparatively large, a larger intake angle having a favorable effect on the overall size of the gyratory crusher.

However, independently of a facilitated intake effect of the quarry material into the intake cone, the disadvantage arises that in the case of comparatively fine quarry material which is infed into the crushing space intense compaction of material may result, leading to sinking of the material during each eccentric revolution of the crushing cone under the influence of gravity. The comparatively coarse quarry material which is infed via the crushing throat into the crushing space may have edge lengths of up to two meters, for example, such that this quarry material in the upper region of the crushing space still forms a comparatively low bulk density, since the coarse granules of the quarry material are mutually supportive and allow large cavities to form. However, in the lower region of the crushing space the annular gap between the crushing cone and the crusher housing will become smaller, and the already pre-comminuted granules may be formed so as to be smaller and more uniform, such that the cavities between the granules also become smaller and the bulk density rises up to a compact mass of material which may be close to the density of the solid quarry material. It has been demonstrated here that the compacting effect is additionally facilitated by the configuration of crushing teeth on the crushing wall surface of the crusher housing and on the surface of the crushing cone, intense compacting of the quarry material even potentially leading to the gyratory crusher being shut down, on account of which undesirable stoppage times of the gyratory crusher are created.

SUMMARY

In some examples a gyratory crusher for comminuting quarry material may comprise a crushing cone and a crusher housing, wherein a circumferential crushing space extends between the crushing cone and the crusher housing. Moreover, the crushing space may open into a crushing throat that is open toward the top and via which the quarry material may be infed into the crushing space. Further, the crushing space may taper off downward into a crushing gap via which the comminuted quarry material may exit from the crushing space.

It is an object of the invention to refine a gyratory crusher for comminuting quarry material, in which intense compaction of the quarry material is to be avoided. The object of achieving a gyrator crusher into which quarry material having a comparatively fine initial grain may be infed arises in particular, wherein intense material compaction is avoided in particular in the lower region of the crushing space.

Proceeding from a gyratory crusher according to the preamble of claim 1, this object is achieved in conjunction with the characterizing features. Advantageous refinements of the invention are stated in the dependent claims.

The invention incorporates the technical teaching that the crushing wall surface of the crusher housing, which points inward toward the crushing cone and delimits the crushing space, in the upper region commencing at the crushing throat has an undulation, which is also referred to herein as an undulated surface, wherein the waves of the undulation in the circumferential direction alternatingly form wave troughs and wave peaks.

On account of the design embodiment according to the invention of the crushing wall surface of the crusher housing, the crushing space in the upper region is designed so as to be tighter, and compacting of the quarry material in the crushing space increases to a lesser extent than in a crushing wall surface that is substantially continuously smooth up to the crushing throat, or in case of a disposal of crushing teeth on the crushing wall surface. An undulated contour of the external crushing wall surface is created by the undulation, and comparatively fine quarry material which is infed into the crushing space can no longer be distributed in such a homogenous and uniform manner in the crushing space. In this way the crushing space, on account of the interference in the contour, in the upper region is not filled to such an extremely dense extent. More and comparatively large cavities are again created in the upper region of the crushing space, on account of which bulking of the material is created. The result is lower material compaction which is continued into the lower region of the crushing space, until the material finally exits the crushing space by way of the crushing gap.

It has proven to be particularly advantageous for the height of the wave peaks above the wave troughs to decrease in the downward direction toward the crushing gap. In the upper peripheral region of the crushing throat, the undulation may have a maximum configuration which decreases in a downward manner. On account thereof, it is achieved that in particular in the upper region of the crushing space the clear width between the crushing cone and the crusher housing is decreased, on account of which material which is still loose in the upper region of the crusher housing is not compacted in such a rapid manner when said material sinks down any further. Moreover, the advantage of the undulation not being configured across the entire height of the crushing wall surface is achieved, since the crushing wall surface in that region of the crushing space that is continued in a downward manner comes close to the surface of the crushing cone, wherein an excessive reduction of the clear width between the crushing wall surface and the crushing cone in the lower region of the crushing space is rather undesirable.

Commencing at the crushing throat, the undulation in the direction toward the crushing gap may even peter out into a funnel-shaped and smooth lower crushing wall surface. For example, the undulation may extend across one third to two thirds of the entire crushing wall height, or the undulation extends up to only half the height of the crushing wall, for example, such that the crushing wall on its lower half of the crushing wall height has a smooth surface.

For example, the crushing space in the region of the crushing throat may have a radial opening dimension in relation to the crushing cone, wherein the height dimension of the wave peaks above the wave troughs of the undulation corresponds to 5% to 25%, preferably 7.5% to 20%, and particularly preferably to 10% to 15% of the radial opening dimension. For example, the radial opening dimension and thus the clear width between the crushing cone and the crushing wall surface in the upper peripheral region of the crushing throat without the undulation may have a dimension of 1560 millimeters, and having the application of the undulation according to the invention on the crushing wall surface the clear width may be reduced to 1400 millimeters, for example.

The exemplary height of the undulation above the crushing wall surface and the height which decreases in the downward direction toward the crushing gap lead to two positive effects during the operation of the gyratory crusher. On the one hand, the quarry material cannot jam in the wave troughs of the undulation, as the radii of the wave troughs increase as the quarry material moves away from the upper periphery of the crushing throat and sinks downward into the crushing space, such that the wave troughs in the circumferential direction are downwardly widened and, on account thereof, the quarry material is afforded more space for spreading out. On the other hand, the effect of spreading of the wave troughs specifically leads to the material hardly being compacted in this region, wherein the material in part may even spread out such that overall compaction when viewed across the crushing space height is lower than in an embodiment of the crushing wall surface without the undulation. On account thereof, the crushing forces and operational disruption by outages caused by overloading of the gyratory crusher are reduced.

An intake angle is defined in a radial plane between the surface of the crushing cone and the surface of the lower, funnel-shaped and smooth crushing wall surface, wherein the intake angle between the crushing cone and the wave troughs of the undulation may steadily continue in an upward direction toward the crushing throat. In this way, the wave troughs with a uniform intake angle with the lower crushing wall surface, and the constant funnel shape of the crusher housing is only disturbed by the wave peaks. The wave peaks here form a type of accretions on the crushing surface, which reduce the clear width of the crusher housing in the upper region of the crushing wall height.

It may furthermore be provided that that the crushing wall surface which delimits the crushing space has crushing plates by way of which the undulation is formed. The crushing plates or armored plates may be releasably attached to the inside of the crusher housing, such that the crushing plates may be replaced, for example as wear progresses. The undulation across the circumference of the crusher housing may have, for example, between 5 waves and 50 waves, preferably 10 waves to 30 waves, and particularly preferably 12 waves to 20 waves. The undulation here may be configured in such a manner that the wave troughs are configured so as to be wider in the downward direction toward the crushing gap in the circumferential direction, and in the upper region which forms the crushing throat, the wave peaks in the circumferential direction may be configured so as to be wider than the wave troughs. The crushing plates may consequently comprise, for example, in each case one wave train consisting of one wave peak and one wave trough, or of one wave peak and of in each case two half wave troughs which are lateral to the wave peak, such that the crushing plates in each case have approximately the same dimensions, the abutment joints between the crushing plates lying in the wave troughs.

Finally, the undulation may furthermore be configured so that the wave peaks form a wave crest, wherein the wave crest is configured as a straight line. In this way, the clear width between the crushing surface and the crushing cone in the direction of the crushing gap tapers off in a uniform manner, until the height of the wave peak above the wave trough is completely reduced to zero. In the point where the undulation transitions into the smooth and uniform funnel of the crusher housing in the lower region of the crushing surface, a type of kink between the wave crest and the tangent on the lower cone-shaped crusher housing is thus created, wherein the transition may also have a radius, such that the wave crest has a soft and stepless transition into the funnel-shaped lower region of the crushing surface.

BRIEF DESCRIPTION OF THE FIGURES

The present disclosure is described in detail below with reference to the attached drawing figures.

DETAILED DESCRIPTION

The following description of example methods and apparatus is not intended to limit the scope of the description to the precise form or forms detailed herein. Instead the following description is intended to be illustrative so that others may follow its teachings.

Figure 1:
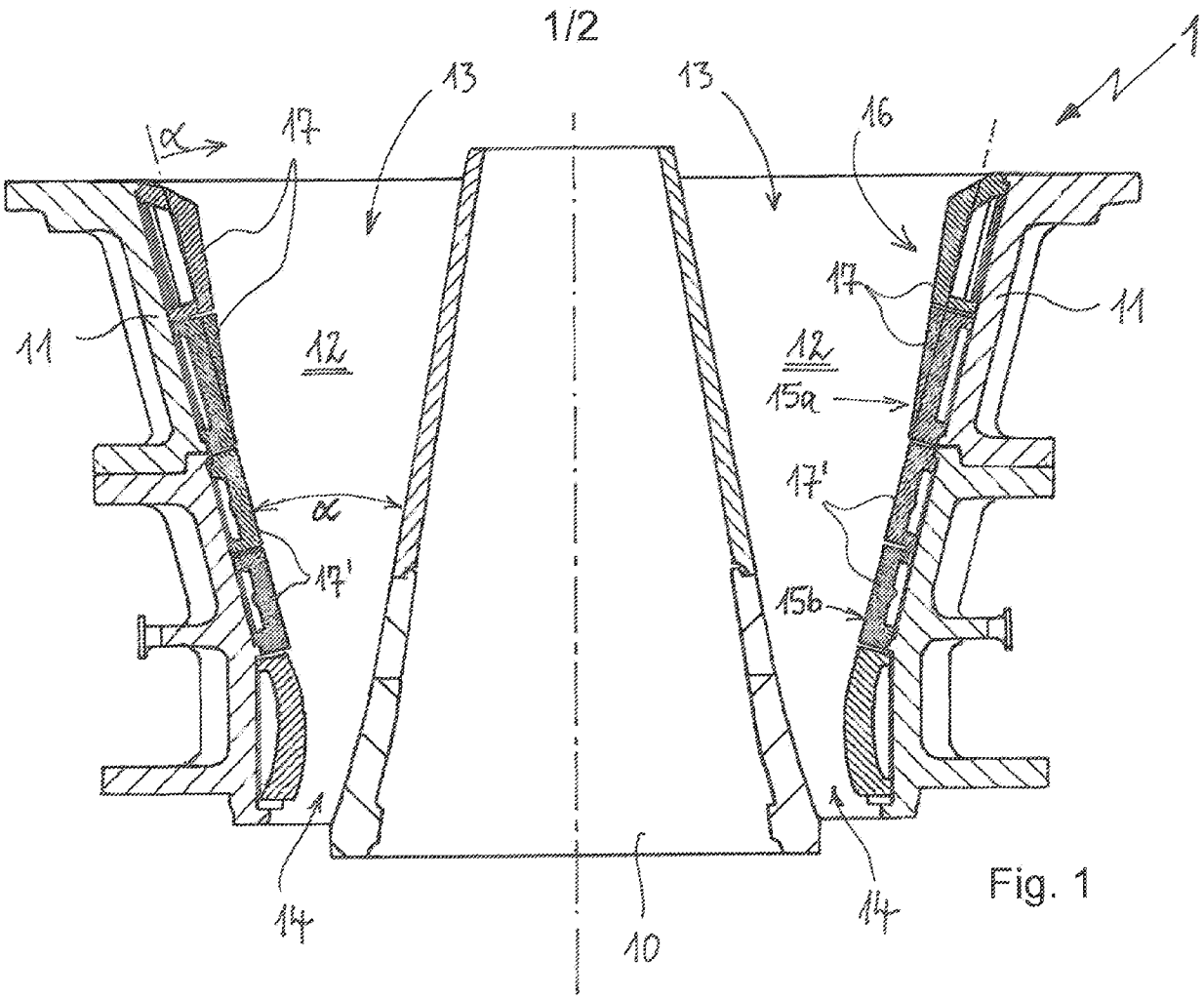
FIG. 1 is a sectional view of an example gyratory crusher.

FIG. 1 shows a gyratory crusher 1 having a crushing cone 10 and having a crusher housing 11 in a sectional view, wherein further component parts of the drive, the cone mounting, and of the foundation of the gyratory crusher 1 are not shown for reasons of simplification.

Together with the crushing cone 10, the crusher housing 11 forms an encircling crushing space 12 which at an intake angle α, which lies in a radial plane, in relation to a crushing throat 13 is open toward the top. In the lower region the crushing cone 10, together with the crusher housing 11, configures an annular crushing gap 14, such that the crushing space 12 tapers off downward into the crushing gap 14. The crushing cone 10, by way of an eccentric (not illustrated), is set into a gyrating rotation movement, such that the crushing gap 14 is periodically enlarged and decreased in a revolving manner.

Figure 2:
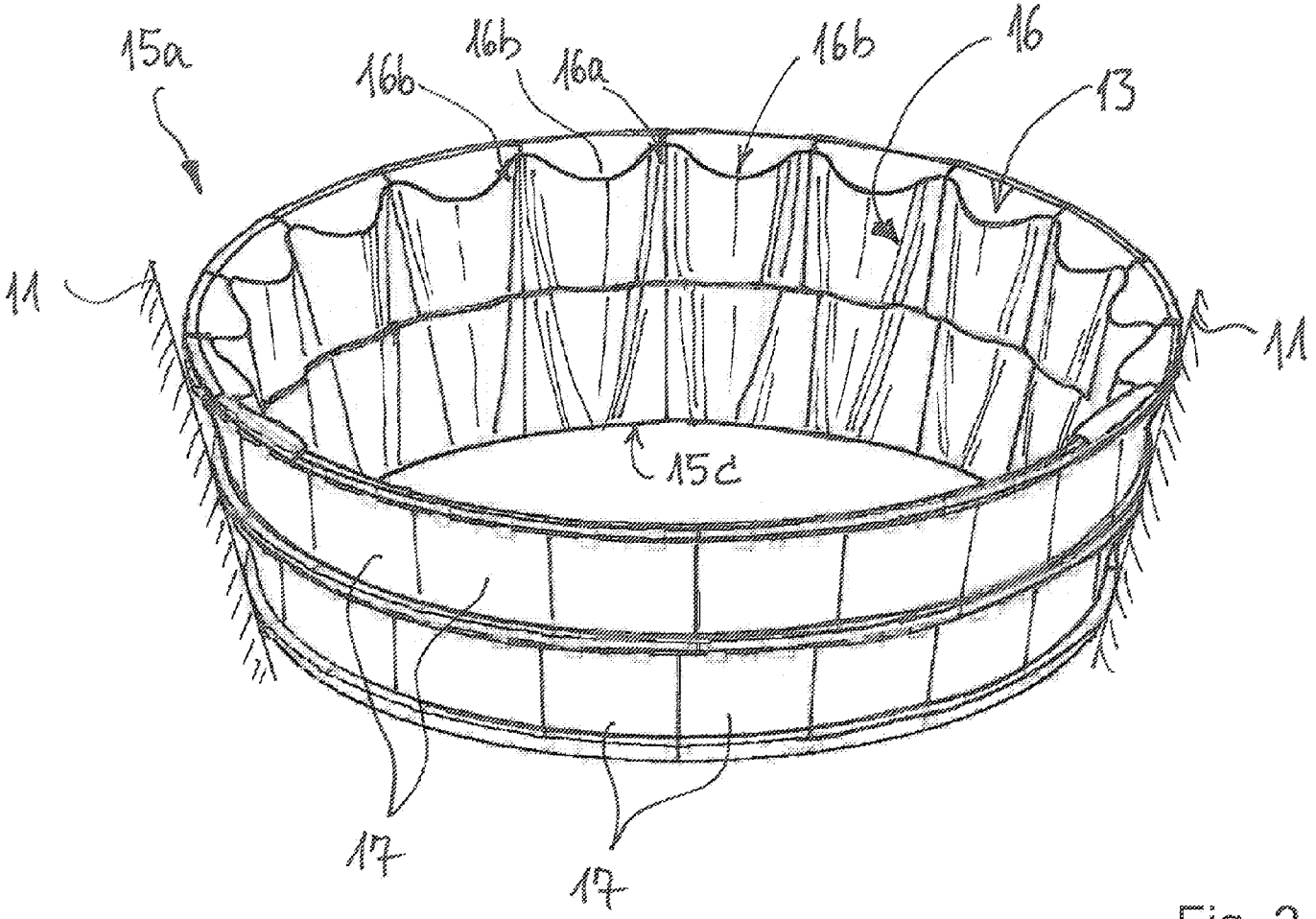
FIG. 2 is a perspective view of an example undulation that can be used to form an upper crushing wall surface of an example crusher housing.

If and when quarry material is infed into the crushing space 12 by way of the crushing throat 13 on the upper side, the quarry material is crushed by the clear width of the encircling crushing space 12, which is being periodically enlarged and decreased. Crushing plates 17 which according to the invention have an undulation, such as is shown in a perspective view in FIG. 2, are attached to the upper crushing wall surface 15*a*. Crushing plates 17', which are embodied in a conventional manner and without undulation and thus are not mentioned in more detail, are attached to the lower crushing wall surface 15*b*. In order for the graphic illustration of the crushing plates 17 and 17' in FIG. 1 to be simplified, the latter are illustrated only in a lying position in a section, without said crushing plates being illustrated so as to continue in the perspective view into the crusher housing 11.

The undulation 16 is composed of wave troughs 16*a* and wave peaks 16*b*, wherein the wave troughs 16*a* and the wave peaks 16*b* in the circumferential direction of the upper crushing wall surface 15*a* are periodically sequenced. An intake angle α, which in the wave troughs 16*a* of the undulation 16 continues into the upper region of the crushing wall surface 15*a*, is defined between the crusher housing 11 and the crushing cone 10. The wave peaks 16*b* on the upper crushing plates 17 thus form moldings reaching into the crushing space 12, on account of which the clear width between the crushing cone 10 and the crusher housing 11 is reduced only in the upper region.

FIG. 2, in a perspective view, shows the upper crushing wall surface 15*a* which is formed from a multiplicity of crushing plates 17 which are designed so as to have an undulation 16. The crushing plates 17 here are disposed beside one another in such a manner that the undulation 16 in the circumferential direction forms sequential wave troughs 16*a* and wave peaks 16*b*. For illustrative purposes the crusher housing 11 is only indicated in a schematic manner, without a perspective view.

The crushing throat 13 is configured in the upper region of the crushing wall surface 15*a*, and the wave peaks 16*b* in this region are configured so as to be wider than the wave troughs 16*a*. As the spacing from the crushing throat 13 increases toward the lower region of the crushing wall surface 15*a*, the width of the wave peaks 16*b* decreases, while the width of the wave troughs 16*a* increases. Here, the wave peaks 16*b* at the lower periphery 15*c* of the crushing wall surface 15*a* thus peter out into the lower surface of the wave troughs 16*a*.

By way of the shown undulation 16 it is achieved that material compactions are formed to a lesser extent even when comparatively fine quarry material is loaded into the crushing space 12, since regions of loosened material, which widen downward toward the lower periphery 15*c* of the crushing wall surface 15*a* because the wave peaks 16*b* become smaller and in particular narrower, are formed by the wave troughs 16*a* which lie between the wave peaks 16*b*. On account of this effect, material compaction arises to a lesser extent, such that outages of the gyratory crusher 1 on account of overloading may be avoided.

The invention in its embodiment is not limited to the above-stated and preferred exemplary embodiment. Rather, a multiplicity of variants which utilize the illustrated solution even in embodiments which are of a fundamentally different type are conceivable. All features and/or advantages, including details of the construction or spatial arrangements, which are derived from the claims, the description, or the drawings, may be relevant to the invention both individually as well as in the most varied combinations thereof.

What is claimed is:

1. A gyratory crusher for comminuting quarry material, the gyratory crusher comprising:

a crushing housing having a top and a bottom;

a crushing cone having a top and a bottom, wherein the crushing housing is positioned around the crushing cone such that the crushing housing and the crushing cone define a circumferential crushing space between the crushing housing and the crushing cone, wherein the circumferential crushing space forms a crushing throat that is open and configured to receive quarry material near the top of the crushing housing, wherein the circumferential crushing space tapers towards the bottoms of the crushing housing and the crushing cone but includes a crushing gap through which comminuted quarry material exits the circumferential crushing space;

a crushing wall surface of the crushing housing, the crushing wall surface facing inwards toward the crushing cone and delimiting the circumferential crushing space at least in part, wherein the crushing wall surface includes a lower region and an upper region; and an undulated surface disposed along the upper region of the crushing wall surface of the crushing housing near the crushing throat, wherein waves of the undulated surface along a circumferential direction include wave troughs and wave peaks, wherein widths of the wave troughs in the lower region towards the crushing gap are wider than the widths of the wave troughs in the upper region towards the crushing throat.

2. The gyratory crusher of claim 1 wherein heights of the wave peaks relative to the wave troughs decrease as proximity to the crushing gap increases.

3. The gyratory crusher of claim 1 wherein the undulated surface commences at the crushing throat and gradually transitions into a smooth funnel-shaped lower crushing wall surface.

4. The gyratory crusher of claim 3 wherein an intake angle is defined in a radial plane between the crushing cone and either the wave troughs or the smooth funnel-shaped lower crushing wall surface, wherein the intake angle increases as proximity to the crushing throat increases.

5. The gyratory crusher of claim 4 wherein the intake angle increases continuously as proximity to the crushing throat increases.

6. The gyratory crusher of claim 1 wherein the undulated surface extends across one-third to two-thirds of a height of the crushing wall surface.

7. The gyratory crusher of claim 1 wherein a radial opening dimension is a distance as measured radially and horizontally outwards from the crushing cone to the crushing wall surface, wherein a height of the wave peaks in relation to the wave troughs corresponds to 10% to 15% of the radial opening dimension.

8. The gyratory crusher of claim 1 wherein a radial opening dimension is a distance as measured radially and horizontally outwards from the crushing cone to the crushing wall surface, wherein a height of the wave peaks in relation to the wave troughs corresponds to 7.5% to 20% of the radial opening dimension.

9. The gyratory crusher of claim 1 wherein a radial opening dimension is a distance as measured radially and horizontally outwards from the crushing cone to the crushing wall surface, wherein a height of the wave peaks in relation to the wave troughs corresponds to 5% to 25% of the radial opening dimension.

10. The gyratory crusher of claim 1 wherein the undulated surface of the crushing wall surface comprises crushing plates.

11. The gyratory crusher of claim 1 wherein the undulated surface comprises between five and fifty waves along a circumference of the crusher housing.

12. The gyratory crusher of claim 1 wherein the undulated surface comprises between ten and thirty waves along a circumference of the crusher housing.

13. The gyratory crusher of claim 1 wherein the undulated surface comprises between twelve and twenty waves along a circumference of the crusher housing.

14. The gyratory crusher of claim 1 wherein one or more of the wave peaks of the undulated surface comprises a wave crest having a straight line profile without any steps from the crushing throat downwards towards the crushing gap.

* * * * *